US008683843B2

(12) United States Patent
Ando et al.

(10) Patent No.: US 8,683,843 B2
(45) Date of Patent: Apr. 1, 2014

(54) SPINNING METHOD FOR FORMING PIPE END

(75) Inventors: Akihiro Ando, Hyogo (JP); Kazushi Sakamoto, Hyogo (JP); Shinobu Karino, Hyogo (JP); Kenji Hara, Hyogo (JP)

(73) Assignee: Nisshin Steel Co., Ltd., Tokyo (JP)

( * ) Notice: Subject to any disclaimer, the term of this patent is extended or adjusted under 35 U.S.C. 154(b) by 952 days.

(21) Appl. No.: 12/081,355

(22) Filed: Apr. 15, 2008

(65) Prior Publication Data

US 2009/0255309 A1 Oct. 15, 2009

(51) Int. Cl.
*B21D 19/04* (2006.01)
*B21D 22/14* (2006.01)

(52) U.S. Cl.
USPC ..... 72/370.11; 72/82

(58) Field of Classification Search
USPC ..... 72/120–125, 370.1, 82–85, 110, 366.2, 72/367.1, 370.11, 80, 81, 126; 29/890, 29/DIG. 41
See application file for complete search history.

(56) References Cited

U.S. PATENT DOCUMENTS

| | | | | |
|---|---|---|---|---|
| 1,847,794 | A * | 3/1932 | Takeda | 72/83 |
| 3,072,086 | A * | 1/1963 | Birchfield et al. | 72/83 |
| 4,036,044 | A * | 7/1977 | Yoshimura | 72/85 |
| 4,055,976 | A * | 11/1977 | Kraft | 72/83 |
| 7,013,690 | B2 * | 3/2006 | Massee | 72/84 |
| 7,174,634 | B2 * | 2/2007 | Morikawa et al. | 29/890 |

FOREIGN PATENT DOCUMENTS

| | | |
|---|---|---|
| JP | 11-132038 | 5/1999 |
| JP | 2003-342694 | 12/2003 |
| JP | 2004-243354 | 9/2004 |

* cited by examiner

*Primary Examiner* — Teresa M Ekiert
(74) *Attorney, Agent, or Firm* — Wenderoth, Lind & Ponack, LLP

(57) ABSTRACT

A spinning method for forming pipe bodies of varying diameter. In the spinning method, when a necked portion is formed at the end of the pipe material by the spinning method, working rollers are restricted so as to return immediately before the pipe end instead of being allowed to axially move beyond the end of the working object pipe. The amount of diameter reduction at the pipe end is set to be smaller than that of the most diameter reduced portion connecting to the pipe end. A protruding portion of a so-called bellmouth shape is formed at the working end, thereby preventing generation of fractures originating at the working end of the base portion or the welded portion and generation of wrinkles during the spinning process.

4 Claims, 4 Drawing Sheets

SPINNING METHOD FOR FORMING PIPE END

BACKGROUND OF THE INVENTION

I. Technical Field

The present invention relates to a forming method for pipe bodies having necked portions at pipe ends, which are used for converter cases or mufflers of automobiles.

II. Description of Related Art

For cases of exhaust gas cleaning catalyst converters or cases of silencer mufflers mounted to exhaust systems of automobiles, pipes of large diameter are used due to a need for larger capacity. Ends of the case member have tapered portions for connecting to adjacent members and, as needed, straight pipe portions of small diameter that are continuous with the tapered portions.

FIG. 1 shows an example of a case 1 with a portion (1*c*) of a pipe of a large diameter, which is a pipe stock portion, tapered portions (1*b*) provided for connecting to the adjacent members, and straight pipe portions (1*a*) of small diameter continuous with the tapered portions. As a forming method therefore, a spinning method is used in many cases.

The spinning method is a method by which working rollers as forming tools are brought into contact with a surface of the working object pipe. While being relatively revolved around the working object pipe, the working rollers are driven in both the radius direction and the axial direction of the working object pipe, thereby forming the tapered portions, which are gradually reduced in diameter toward the ends of the working object pipe, and, as needed, the straight pipe portions of small diameter continuous therewith.

For example, JP 11-132038A discloses that the spinning is performed by pressing the working rollers against the outer surface of the working object pipe, thereby manufacturing a converter case.

Behind the frequent adoption of the spinning method as a method for forming members of the above-mentioned shape, there are the following merits. That is, compared to a method of weld bonding plate materials after press forming, 1) material yield is high, 2) production efficiency is high, 3) member strength is high due to seamless forming, 4) and welding is not required, so reliability of the member is not degraded due to a welded portion, etc.

However, in the spinning method, the working rollers are repeatedly reciprocated in the axial direction of the working object pipe, consequently, the material tends to move toward the pipe end due to plastic deformation, and the thickness of the tapered portion tends to be locally decreased, compared to the ordinary press forming method. Further, fractures originated from the pipe working ends, where the diameter is reduced, tend to occur, at the base portion, or, in case of electric resistance welded pipes, at the welded portion. Furthermore, wrinkles, the nonuniform deformation at the changing the circumferential length of the pipe, tend to be generated during the spinning process, and thus the predetermined working shapes cannot be obtained.

For example, JP 2003-342694 and JP 2004-243354 each suggests a technology, that will suppress the occurrence of crackings originated from the working end of the base portion or the welded portion by adjusting material compositions of the steel, or by regulating the cross-sectional shape of the welded portion, in a case of using ferritic stainless steel pipe.

SUMMARY OF THE INVENTION

However, methods suggested in JP 2003-342694 and JP 2004-243354 are directed to improving the formability of the working object pipe, not improving the working means itself. When any of the methods is adopted, fractures originated from the working end of the base portion or the welded portion cannot be completely eliminated. Further, wrinkles, which tend to be generated during the spinning process, cannot be completely eliminated.

The present invention has been devised to solve the above-mentioned problems. It is the object of the present invention to provide a spinning method which can prevent the generation of fractures originated at the working end of the base portion or the welded portion and generation of wrinkles, during the working operation when the necked portion is formed at the pipe end by abutting working rollers thereon.

In order to achieve the object, the spinning method according to the present invention uses a working object pipe and working rollers disposed on the outer surface of the working object pipe and relatively revolved around the working object pipe, in which, when the working rollers are axially reciprocated while being moved in a radius direction of the working object pipe, to thereby form a tapered portion gradually reduced in diameter toward the end of the object pipe and, as needed, a straight pipe portion of small diameter which continues thereto, the working rollers are restricted to return immediately before the working rollers reach the pipe end during the axial reciprocation thereof so that a protruding portion is formed at the pipe end of the working object pipe.

In the present invention, when the necked portion is formed at the end of the working object pipe by axially reciprocating the working rollers while moving the working rollers in the radius direction of the working object pipe, the working rollers are restricted so as to return immediately before the pipe end instead of being allowed to axially move beyond the end of the working object pipe. As a result, the diameter reduction amount at the pipe end is suppressed to be smaller than that of the most diameter reduced portion connecting to the pipe end. The plastic deformation amount at the pipe end from which fractures are originated is set smaller than that of the most diameter reduced portion of the pipe, thereby suppressing generation of fractures. Further, generation of wrinkles is also suppressed, so the excellent accuracy of the form of the necked portion is obtained.

DETAILED DESCRIPTION OF THE INVENTION

The inventors of the present invention have conducted various studies on a technique of preventing the generation of fractures that originate at a working end of a base portion or a welded portion and the generation of wrinkles during a spinning operation, when a working object pipe and working rollers which are disposed on an outer surface of the working object pipe and relatively revolves around the working object pipe are used, and the working rollers are axially reciprocated while being moved in a radius direction of the working object pipe, to thereby form a tapered portion gradually reduced in diameter toward the end of the working object pipe and, as needed, a straight pipe portion of small diameter.

Figure 1:
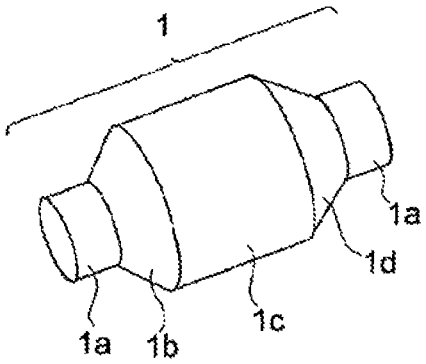
FIG. 1 (PRIOR ART)
FIG. 1 is a perspective view for explaining a shape of a case of a catalyst converter or a muffler.
Figure 2:
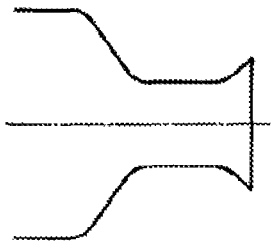
FIG. 2 is a view for explaining a bellmouth-shaped protruding portion formed at a working end of a spinning portion.

As a result, the inventors have found that it is effective that the working rollers are restricted so as to return immediately before the pipe end instead of being allowed to axially move beyond the end of the working object pipe. Also, the diameter reduction amount at the pipe end is set smaller than that of the most diameter reduced portion connected to the pipe end, consequently, a protruding portion of a so-called bellmouth shape is formed at the working end (see FIG. 2).

A detailed description thereof will be made below.

When the working rollers are axially reciprocated while being moved in a radius direction of the working object pipe to form a necked portion at the end of the working object pipe, in a case where the working rollers are allowed to move beyond the end of the working object pipe, factors of generation of fractures originating at the working end of the base portion or the welded portion and generation of wrinkles during the spinning process are considered to be the following.

That is, when the necked portion is formed at the end of the working object pipe by the spinning process, the working object portion undergoes work hardening due to plastic deformation, and gradually becomes hard to deform. Further, when the diameter reduction is continued, due to the strain of the work hardening, a limit of deformation is reached and fractures in the diameter-reduced portion are generated. In this case, the fractures are originated from the working end of the base portion, which has a small material restraint and on which the strain due to local deformation tends to be concentrated, or at the working end of the welded portion, which has a larger deformation resistance than that of the base portion and on which the strain due to local deformation tends to be concentrated. Further, even in a case where fractures are not generated, when a peripheral length of the pipe changes due to diameter reduction, a redundant material or nonuniform deformation tend to be caused at the pipe end at which the material restraint is small, thereby generating wrinkles at the pipe end.

In order to suppress generation of fractures or wrinkles at the working end, it is probably effective to reduce the plastic deformation amount at the pipe end, suppressing the work hardening and increasing the material restraint in the circumferential direction, thereby suppressing the local deformation or the nonuniform deformation.

In order to reduce the plastic deformation amount at the distal end portion of the pipe end or to increase the material restraint in the circumferential direction, it is found to be effective to perform the working operation in the following manner. The working rollers are restricted so as to return immediately before the pipe end instead of being allowed to move beyond the end of the working object pipe. In this manner, the protruding portion of the so-called bellmouth shape is formed at the working end, and the diameter reduction amount at the pipe end is set smaller than that of the most diameter reduced portion connected to the pipe end.

That is, by forming the protruding portion with bellmouth shape at the pipe end to reduce the plastic deformation amount, the work hardening of the working end of the base portion or the welded portion from which fractures are originated is suppressed, so it becomes difficult to reach the limit of the deformation, thereby suppressing fractures. Further, by forming the protruding portion of the bellmouth shape at the working end, the rigidity of the pipe end increases, thereby suppressing generation of wrinkles, that is, the nonuniform deformation at the time of changing the circumferential length of the pipe.

Note that, after the completion of the spinning operation, the protruding portion with bellmouth shape is cut and eliminated, thereby obtaining the necked portion with the predetermined shape.

EXAMPLE 1

A ferritic stainless steel sheet with such mechanical characteristics that yield strength of 251 MPa, tensile strength of 428 MPa, elongation of 36% and thickness of 1.2 mm was used as a material, and working object pipes were formed to a diameter of 120 mm by plasma welding.

Figure 3:
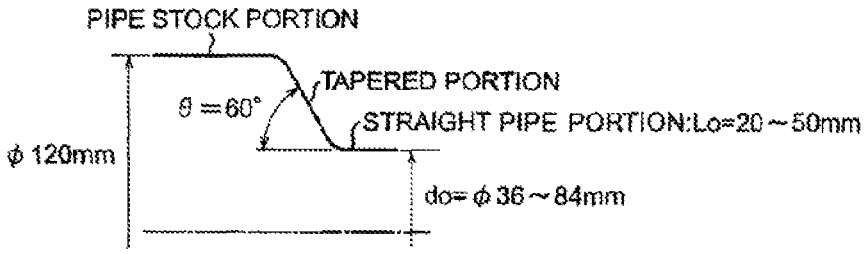
FIG. 3 is a diagram for explaining a target shape of a working portion with respect to which a spinning experiment is conducted in an example.

As shown in FIG. 3, a target shape of coaxial spinning was set to have a tapered angle $\delta$ of 60 degrees, a diameter $d_0$ at the straight pipe portion of 36 to 84 mm (diameter reduction ratio of 30 to 70%), and a length $L_0$ at the straight pipe portion of 20 to 50 mm.

Figure 4A:
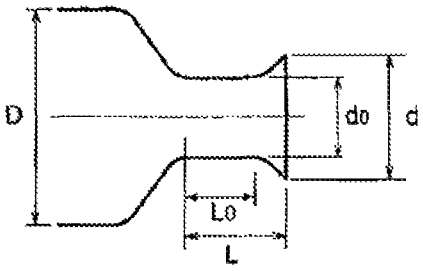
FIGS. 4(*a*) and 4(*b*) are views showing a shape of a spinning end, in which FIG. 4(*a*) is an example of the present invention and FIG. 4(*b*) is a comparative example.
Figure 4B:
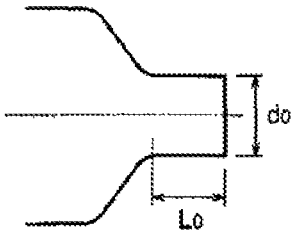

Further, spinning conditions were set, such that a protruding portion with bellmouth shape, as shown in FIG. 4(*a*), was formed so as to satisfy the relationships of $d-d_0 \geq 2t$ and $L-L_0 \geq 2t$, and research was conducted on a formable region depending on generated/not generated of fractures and wrinkles at the working end. For comparison, as shown in FIG. 4(*b*) research was also conducted on a formable region under conditions set in a case where the protruding portion with bellmouth shape was not formed at the working end. In both cases, the working operation was performed three times under each working conditions of the same diameter reduction ratio and the same straight pipe portion length.

Note that, for the spinning conditions, the number of working passes was 7 and an axial roller-feed speed was constantly 4500 mm/min.

Figure 5A:
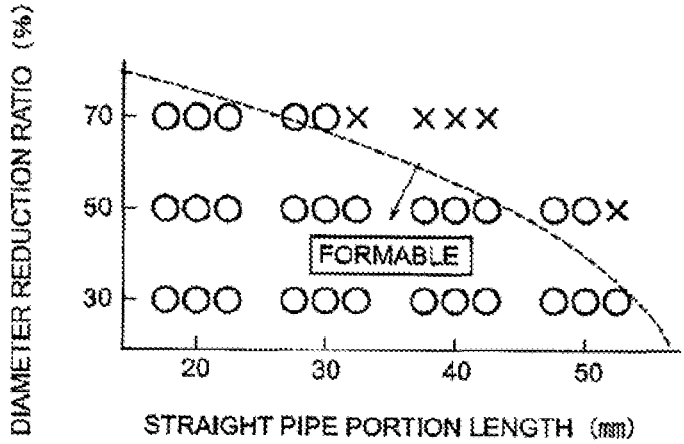
FIGS. 5(*a*) and 5(*b*) are graphs showing a formable range according to Example 1, in which FIG. 5(*a*) is an example of the present invention and FIG. 5(*b*) is a comparative example.
Figure 5B:
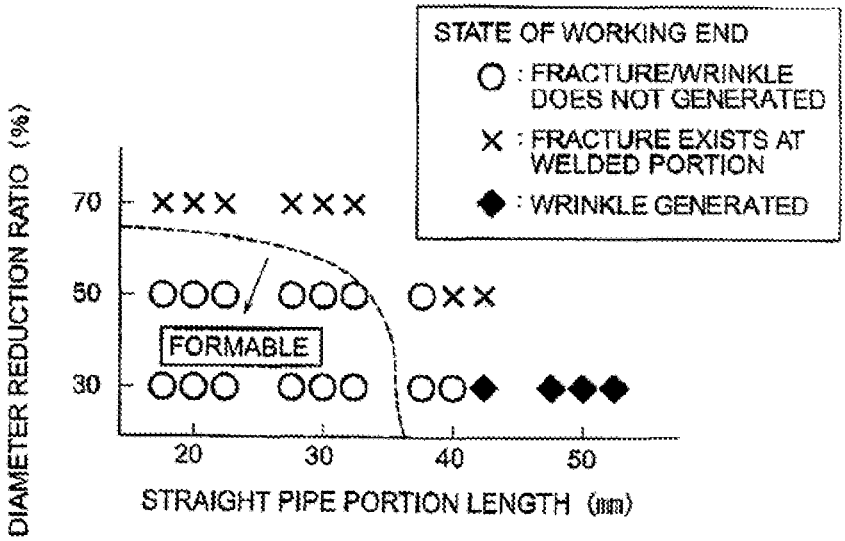

FIGS. 5(*a*) and 5(*b*) show the results.

In the figures, as for diameter reduction ratio and straight pipe portion length, mark ○ represents working conditions under which fractures and wrinkles are not generated, mark x represents working conditions under which fractures are generated at the working end of the welded portion, and mark ◆ represents working conditions under which wrinkles are generated at the working end.

Irrespective of the presence/absence of the protruding portion with bellmouth shape at the working end, the higher the diameter reduction ratio is, or the longer the straight pipe portion length is, the more likely fractures originated from the working end of the welded portion and wrinkles at the working end are generated. It is understood that generation of fractures and wrinkles are suppressed and the formable range is expanded, by forming the protruding portion with bellmouth shape at the working end as shown in FIG. 5(*a*), compared to the case of FIG. 5(*b*) where the protruding portion is not formed.

EXAMPLE 2

A ferritic stainless steel sheet with such mechanical characteristics that yield strength of 239 MPa, tensile strength of 426 MPa, elongation of 36% and thickness of 1.0 mm was used as a material, and working object pipe was formed to the diameter of 120 mm by plasma welding.

As shown in FIG. 3, a target shape of coaxial spinning was set to have a tapered angle $\theta$ of 60 degrees, a diameter $d_0$ at the straight pipe portion of 36 to 84 mm (diameter reduction ratio of 30 to 70%), and a length $L_0$ at the straight pipe portion of 20 to 50 mm.

Further, spinning conditions were set, such that a protruding portion with bellmouth shape, as shown in FIG. 4(*a*), was formed so as to satisfy relationships of $d-d_0 \geq 2t$ and $L-L_0 \geq 2t$, and research was conducted on a formable region depending on the presence/absence of fractures and wrinkles at the working end. For comparison, research was also conducted on a formable region under conditions set in a case where the protruding portion with bellmouth shape was not formed at the working end. In both cases, the working operation was performed three times under each working conditions of the same diameter reduction ratio and the same straight pipe portion length.

Note that, in this example, for the spinning conditions, the number of working passes was 5 and an axial roller-feed speed was constantly 8000 mm/min.

Figure 6A:
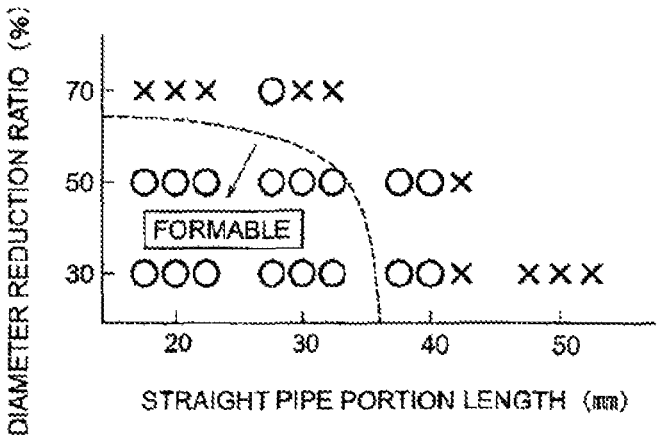
FIGS. 6(*a*) and 6(*b*) are graphs showing a formable range according to Example 2, in which FIG. 6(*a*) is an example of the present invention and FIG. 6(*b*) is a comparative example.
Figure 6B:
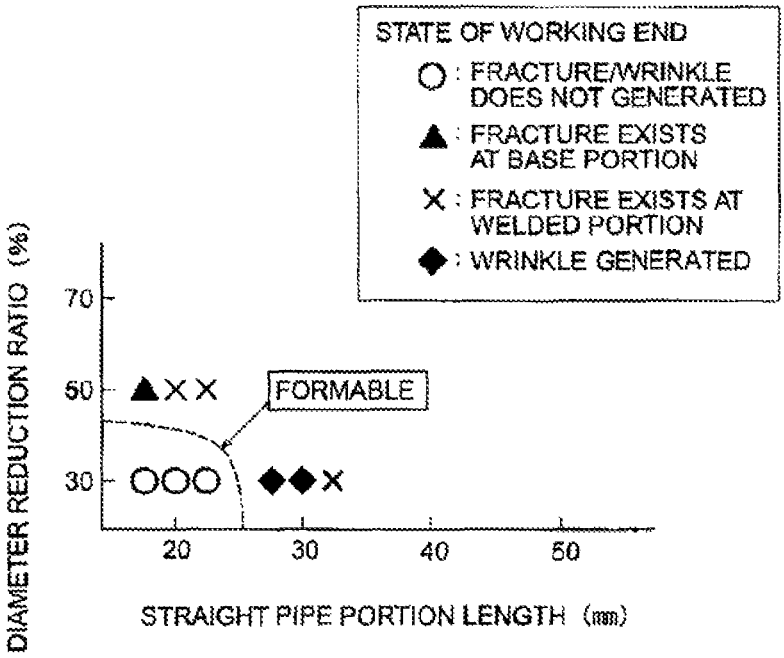

FIGS. 6(*a*) and 6(*b*) show the results.

In the figures, as for diameter reduction ratio and straight pipe portion length, mark ○ represents working conditions under which fractures and wrinkles are not generated, mark ▲ represents working conditions under which fractures are generated at the working end of the base portion, mark x represents working conditions under which fractures are generated at the working end of the welded portion, and mark ♦ represents working conditions under which wrinkles are generated at the working end.

As compared with Example 1, the working amount for one working pass and per unit time is increased, so the formable range becomes narrower.

As in the case of Example 1, irrespective of the presence/absence of the protruding portion with bellmouth shape at the working end, the higher the diameter reduction ratio is, or the longer the straight pipe portion length is, the more likely fractures originating at the working end of the base or from the working end of the welded portion and wrinkles at the working end are generated. It is understood that generations of fractures and wrinkles are suppressed and the formable range is expanded, by forming the protruding portion with the bellmouth shape at the working end as shown in FIG. 6(*a*), compared to the case of FIG. 6(*b*) where the protruding portion is not formed.

As described above, in the present invention of the spinning method, the working rollers are restricted so as to return immediately before the pipe end instead of being allowed to axially move beyond the end of the working object pipe, consequently the protruding portion with the bellmouth shape is formed at the working end, when the working rollers are axially reciprocated while being moved in the radius direction of the working object pipe to form the necked portion at the end of the working object pipe. Accordingly, the plastic deformation amount at the pipe end where fractures and wrinkles are generated can be relatively smaller than the plastic deformation amount at the most shrunken necked portion, that is, the base or the welded portion of the straight pipe portion of the smallest diameter. Therefore, generation of fractures or wrinkles at the working end is suppressed, and excellent accuracy of the form of the necked portion is obtained.

As a result, the quality of components manufactured by the spinning process can be improved. Further, the formable range is increased, so setting of the spinning conditions for obtaining components of the predetermined shape can be facilitated. Accordingly, the development period can be made shorter and development costs can be reduced.

The invention claimed is:

1. A spinning method for forming a pipe body, the method comprising:

providing a working object pipe;

positioning a plurality of working rollers on an outer surface of the working object pipe, the working rollers being configured to be relatively revolved around the working object pipe;

forming a tapered portion from a large diameter portion of the working object pipe by axially reciprocating the working rollers while moving the working rollers in a radial direction of the working object pipe, the tapered portion being gradually reduced in diameter toward an end of the working object pipe; and forming a protruding portion having a bellmouth shape at an end portion of the working object pipe by returning the working rollers just before the working rollers reach the end of the working object pipe during axial reciprocation thereof.

2. A spinning method for forming a pipe body, the method comprising:

providing a working object pipe;

positioning a plurality of working rollers on an outer surface of the working object pipe, the working rollers being configured to be relatively revolved around the working object pipe;

forming a tapered portion from a large diameter portion of the working object pipe by axially reciprocating the working rollers while moving the working rollers in a radial direction of the working object pipe, the tapered portion being gradually reduced in diameter toward an end of the working object pipe; and forming a straight pipe portion that extends from an end of the tapered portion, the straight pipe portion having a diameter that is smaller than a remainder of the working object pipe; and forming a protruding portion having a bellmouth shape at an end portion of the working object pipe by returning the working rollers just before the working rollers reach the end of the working object pipe during axial reciprocation thereof.

3. The spinning method as claimed in claim 1, further comprising removing the protruding portion with the bellmouth shape.

4. The spinning method as claimed in claim 2, further comprising removing the protruding portion with the bellmouth shape.

* * * * *